US010543971B1

(12) United States Patent
Determan

(10) Patent No.: US 10,543,971 B1
(45) Date of Patent: Jan. 28, 2020

(54) POURING SPOUT SYSTEM

(71) Applicant: Thomas W. Determan, Lakeland, FL (US)

(72) Inventor: Thomas W. Determan, Lakeland, FL (US)

( * ) Notice: Subject to any disclaimer, the term of this patent is extended or adjusted under 35 U.S.C. 154(b) by 0 days.

(21) Appl. No.: 16/250,085

(22) Filed: Jan. 17, 2019

Related U.S. Application Data

(60) Provisional application No. 62/618,982, filed on Jan. 18, 2018.

(51) Int. Cl.
*B65D 75/58* (2006.01)

(52) U.S. Cl.
CPC ..... *B65D 75/5866* (2013.01)

(58) Field of Classification Search
CPC ..... B65D 75/5866; B65D 75/5861; B65D 75/5872; B65D 75/5883; B65D 25/42; B65D 25/44
USPC ..... 222/574
See application file for complete search history.

(56) References Cited

U.S. PATENT DOCUMENTS

| | | | | | |
|---|---|---|---|---|---|
| 1,973,956 | A * | 9/1934 | Hickman | B65D 33/30 | 383/120 |
| 2,575,191 | A * | 11/1951 | Seipp | B65D 31/04 | 383/97 |
| 2,772,823 | A * | 12/1956 | Plamann | B65D 75/5805 | 222/527 |
| 7,004,630 | B2 * | 2/2006 | Piechocki | B65D 33/2525 | 383/36 |
| 2008/0210707 | A1 * | 9/2008 | Kitai | B65D 5/746 | 222/1 |
| 2016/0096657 | A1 * | 4/2016 | Satkiewicz | B65D 75/5872 | 222/566 |
| 2018/0022513 | A1 * | 1/2018 | Kerstetter | B65D 75/5877 | 222/1 |

* cited by examiner

*Primary Examiner* — Benjamin R Shaw

(57) ABSTRACT

A pouring device is for use with a bag having an open top and a closed bottom and side walls between the open top and the closed bottom, the bag having a domain between the side walls laterally and the open top and closed bottom elevationally for contents to be poured. The pouring device is located within the domain. The pouring device includes a fixed component and a movable component.

3 Claims, 6 Drawing Sheets

FIG. 16
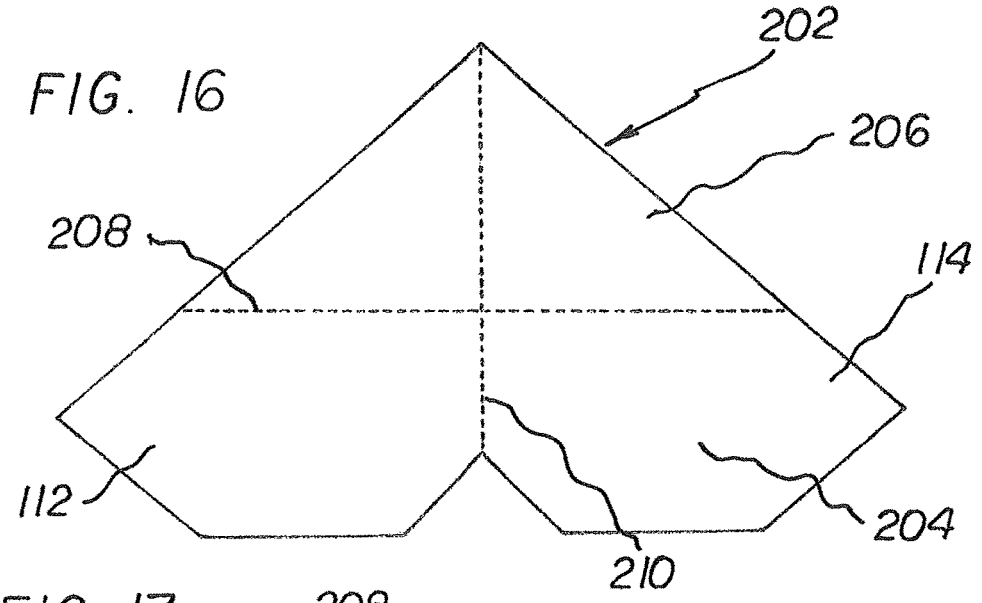
FIG. 17
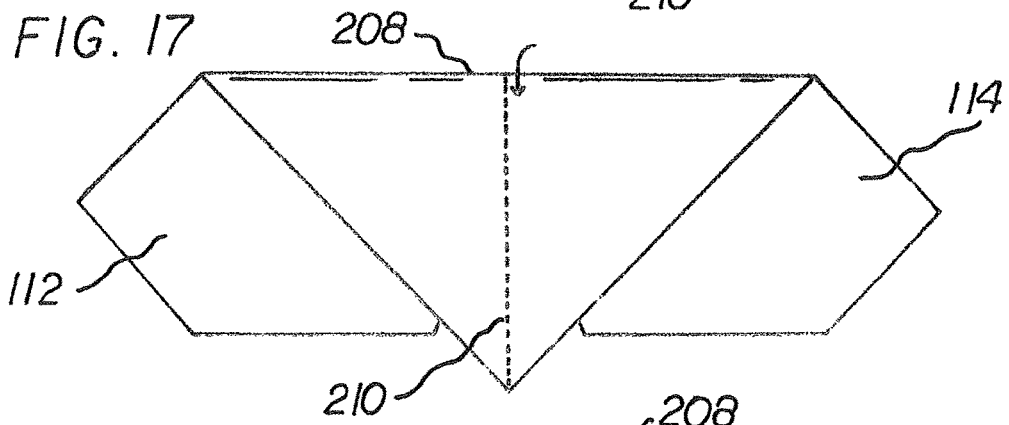
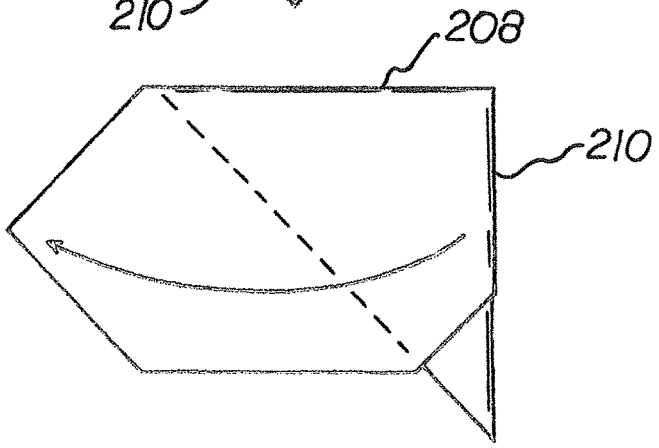
FIG. 18

POURING SPOUT SYSTEM

RELATED APPLICATION

This application is based upon Provisional Application No. 62/618,982 filed Jan. 18, 2018, the subject matter of which is incorporated herein by reference and the priority of which is hereby claimed.

BACKGROUND OF THE INVENTION

Field of the Invention

The present invention relates to a pouring spout system and more particularly pertains to pouring stored contents in a safe, convenient, and economical manner.

Description of the Prior Art

The use of pouring spout systems of known designs and configurations is known in the prior art. More specifically, pouring spout systems of known designs and configurations previously devised and utilized for the purpose of pouring stored contents are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a pouring spout system that allows pouring stored contents in a safe, convenient, and economical manner.

In this respect, the pouring spout system according to the present invention substantially departs from the conventional concepts and designs of the prior art, and in doing so provides an apparatus primarily developed for pouring stored contents in a safe, convenient, and economical manner.

Therefore, it can be appreciated that there exists a continuing need for a new and improved pouring spout system which can be used for pouring stored contents in a safe, convenient, and economical manner. In this regard, the present invention substantially fulfills this need.

SUMMARY OF THE INVENTION

In view of the foregoing disadvantages inherent in the known types of pouring spout systems of known designs and configurations of known designs and configurations now present in the prior art, the present invention provides an improved pouring spout system. As such, the general purpose of the present invention, which will be described subsequently in greater detail, is to provide a new and improved pouring spout system and method which has all the advantages of the prior art and none of the disadvantages.

To attain this, the present invention essentially comprises a pouring device for use with a bag having an open top and a closed bottom and side walls between the open top and the closed bottom, the bag having a domain between the side walls laterally and the open top and closed bottom elevationally for contents to be poured. The pouring device is located within the domain. The pouring device includes a fixed component and a movable component.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pouring spout system which has all of the advantages of the prior art pouring spout systems of known designs and configurations of known designs and configurations and none of the disadvantages.

It is another object of the present invention to provide a new and improved pouring spout system which may be easily and efficiently manufactured and marketed.

It is further object of the present invention to provide a new and improved pouring spout system which is of durable and reliable constructions.

An even further object of the present invention is to provide a new and improved pouring spout system which is susceptible of a low cost of manufacture with regard to both materials and labor, and which accordingly is then susceptible of low prices of sale to the consuming public, thereby making such pouring spout system economically available to the buying public.

Lastly, it is another object of the present invention is to provide a pouring spout system which can be used for pouring stored contents in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 16 is a front elevational view of the pouring spout of FIG. 14 but prior to folding and coupling to a bag.

FIG. 17 is a front elevational view similar to FIG. 16 but after folding about a horizontal fold line.

FIG. 18 is a front elevational view similar to FIG. 17 but after folding about a vertical fold line.

The same reference numerals refer to the same parts throughout the various Figures.

DESCRIPTION OF THE PREFERRED EMBODIMENT

Figure 1:
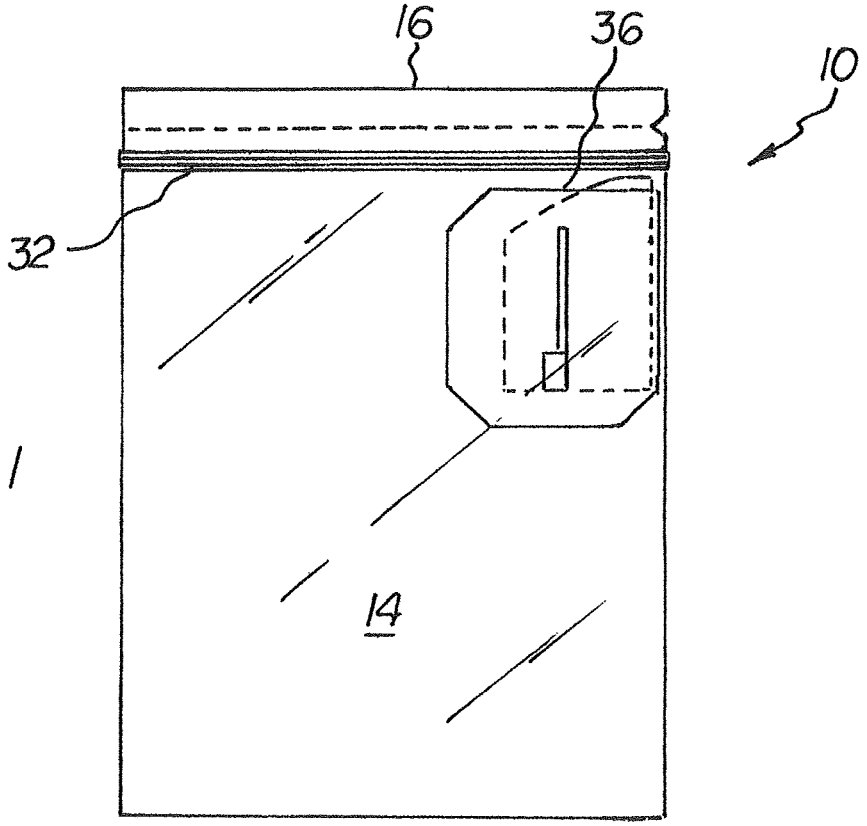
FIG. 1 is a front elevational view of a pouring spout system constructed in accordance with the principles of the present invention, the system being in an inoperative orientation.
Figure 2:
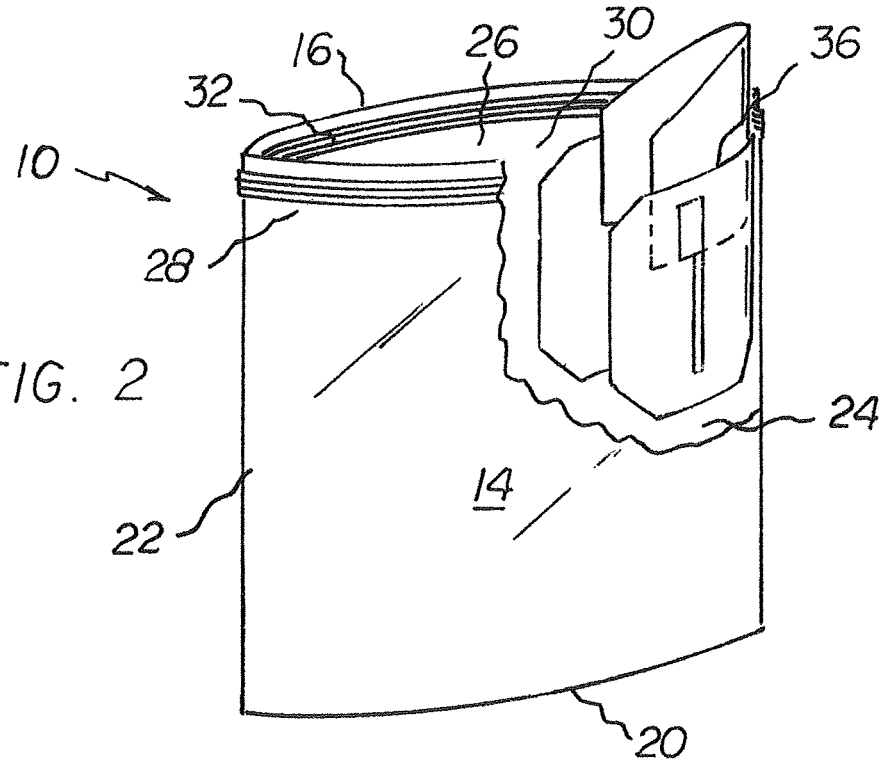
FIG. 2 is a front perspective view of the pouring spout system of FIG. 1, the system being in an operative orientation, the system having portions broken away to show certain internal constructions thereof.
Figure 3:
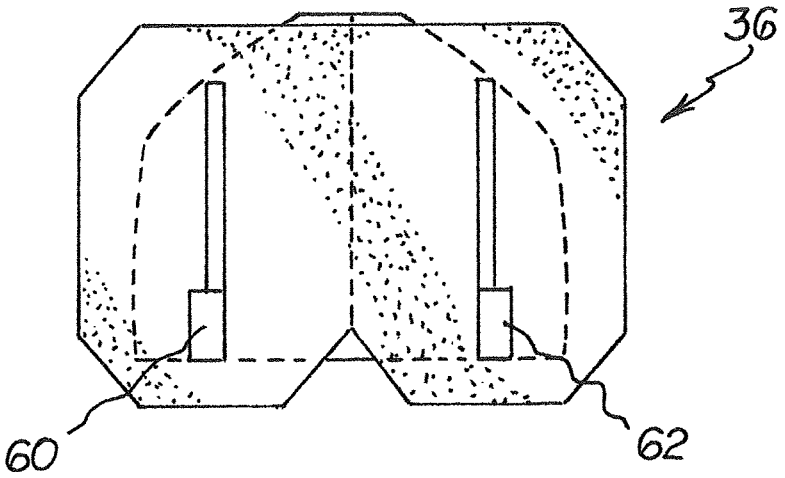
FIG. 3 is a front elevational view of the pouring spout assembly, fixed component and movable component, as shown in FIG. 1.
Figure 4:
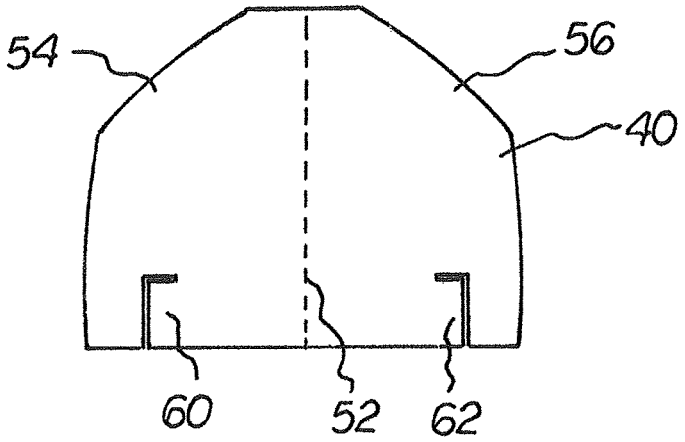
FIG. 4 is a front elevational view of the movable component, as shown in FIGS. 1, 2, and 3.
Figure 5:
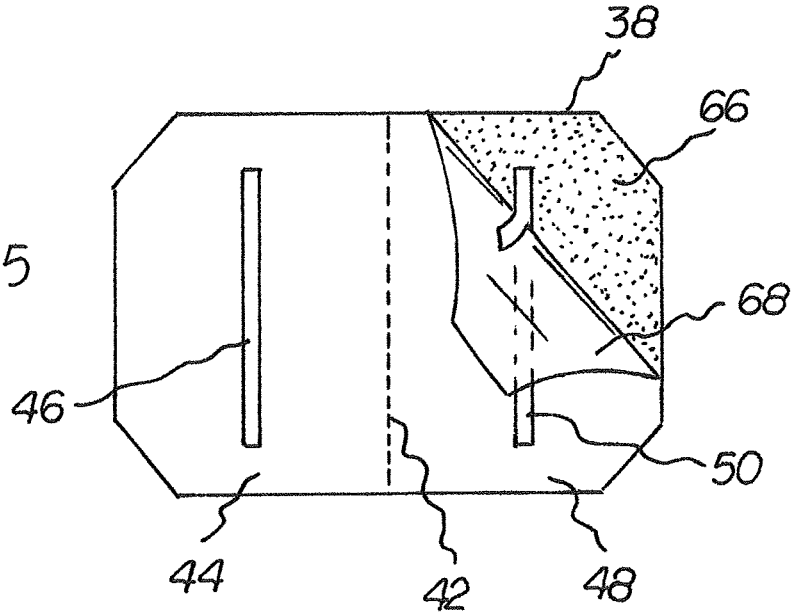
FIG. 5 is a front elevational view of the fixed component as shown in FIGS. 1, 2, and 3.
Figure 6:
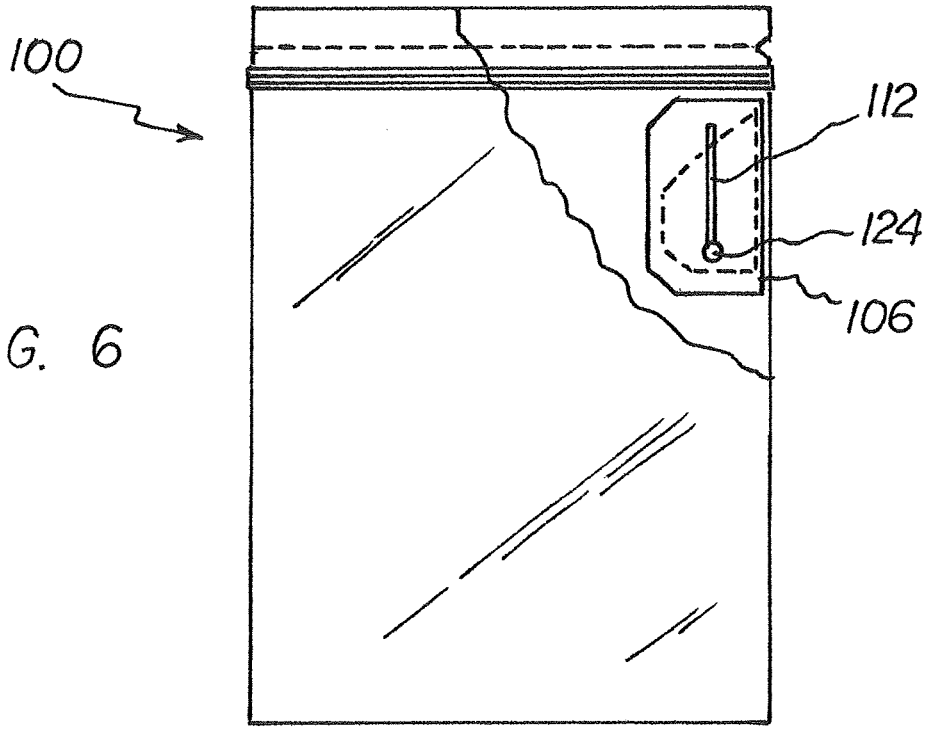
FIG. 6 is a front elevational view of a pouring spout system constructed in accordance with an alternate embodiment of the present invention, the system being in an inoperative orientation, the system having portions broken away to show certain internal constructions thereof.
Figure 7:
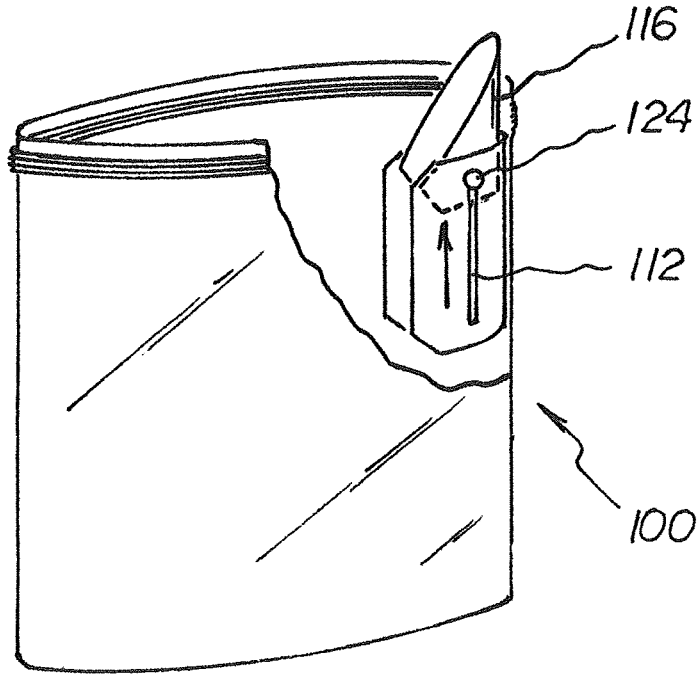
FIG. 7 is a perspective view of the pouring spout system shown in FIG. 6, the system being in an operative orientation, the system having portions broken away to show certain internal constructions thereof.
Figure 9:
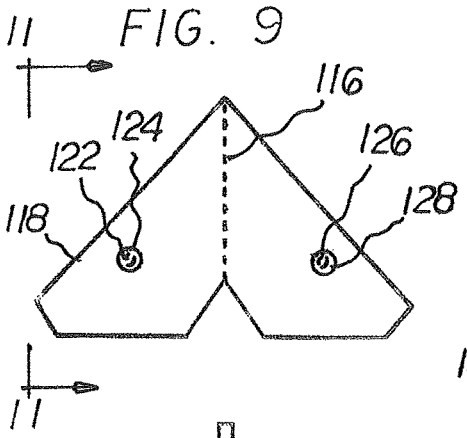
FIG. 9 is a front elevational view of the movable component of the FIG. 6 system.
Figure 10:
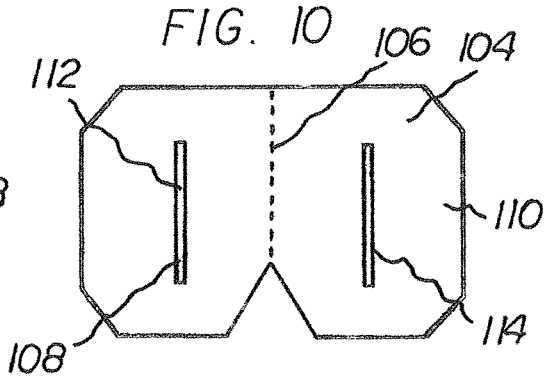
FIG. 10 is a front elevational view of the fixed component of the FIG. 6 system.
Figure 11:
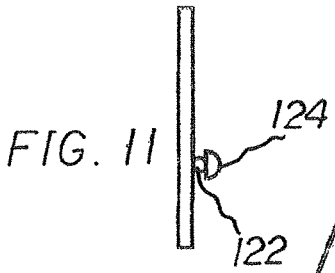
FIG. 11 is a side elevational view of the movable component taken along line 11-11 of FIG. 9.
Figure 12:
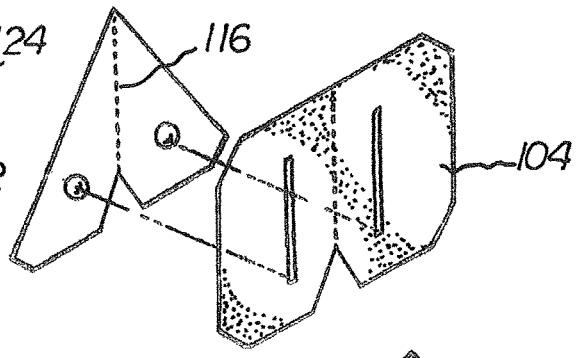
FIG. 12 is an exploded perspective view of the fixed and movable components of the FIG. 6 system.
Figure 8:
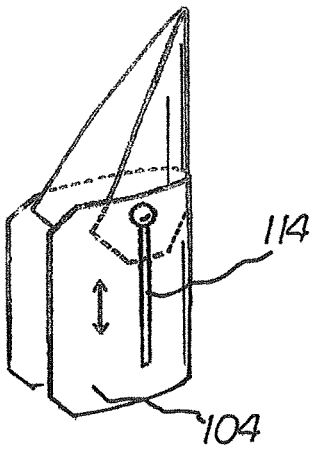
FIG. 8 is a perspective illustration of the pouring spout assembly in an operative orientation as shown in FIG. 7.
Figure 13:
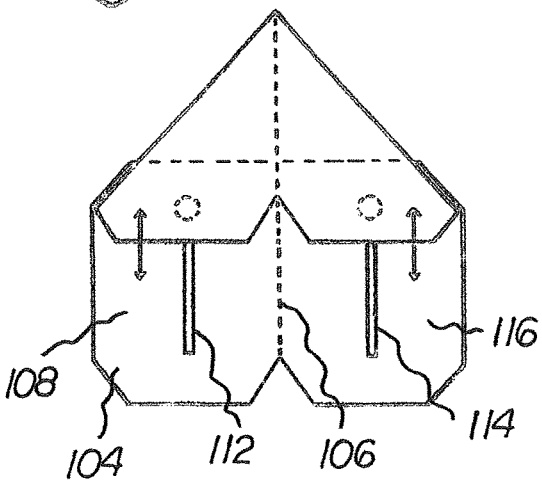
FIG. 13 is a front elevational view of the pouring spout assembly in an operative orientation as shown in FIG. 7.
Figure 14:
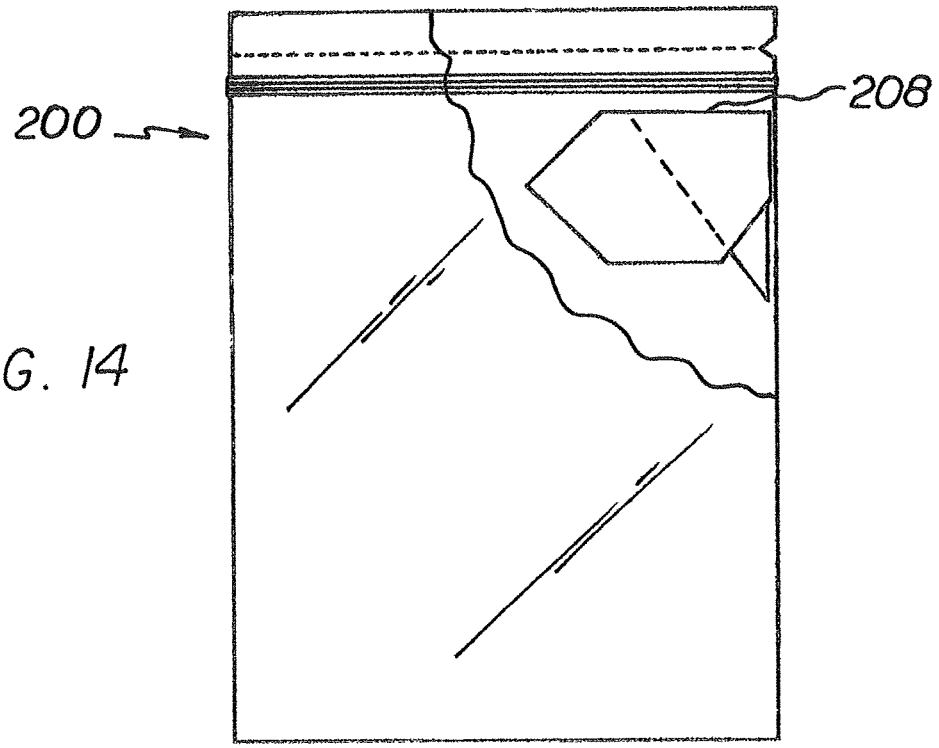
FIG. 14 is a front elevational view of a pouring spout system constructed in accordance with an additional alternate embodiment of the invention, the system being in an inoperative orientation, the system having portions broken away to show certain internal constructions thereof.
Figure 15:
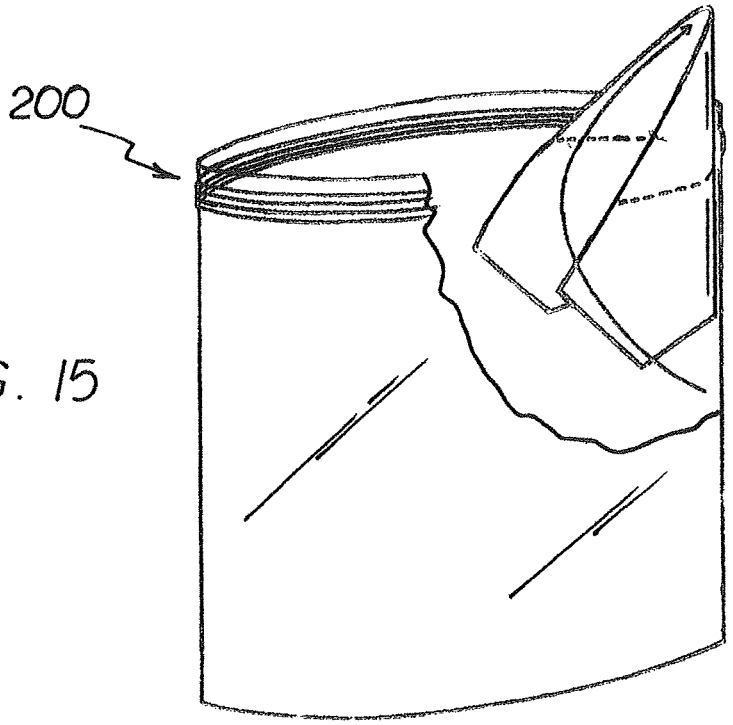
FIG. 15 is a perspective view of the pouring spout system shown in FIG. 14, the system being in an operative orientation, the system having portions broken away to show certain internal constructions thereof.

With reference now to the drawings, and in particular to FIG. 1 thereof, the preferred embodiment of the new and improved pouring spout system embodying the principles and concepts of the present invention and generally designated by the reference numeral 10 will be described.

The present invention, the pouring spout system 10 is comprised of a plurality of components. Such components in their broadest context include a bag and a pouring spout. Such components are individually configured and correlated with respect to each other so as to attain the desired objective.

The preferred embodiment of the pouring spout system 10 for pouring stored contents is illustrated in FIGS. 1 through 5. The pouring of stored contents is done in a safe, convenient, and economical manner. First provided in this embodiment is a bag 14. The bag has a top 16 and a bottom 20. The bag also has first and second side walls 22, 24 between the top and the bottom. The bag has interior and exterior surfaces 26, 28. The top has an opening between the first and second side walls. A separable closure 32 is provided adjacent to the opening. A chamber 30 is beneath the separable closure. The chamber is for receiving contents.

Next provided is a pouring assembly 36. The pouring assembly has a fixed component 38 and a movable component 40.

The fixed component includes a vertical centerline 42 creating a left side 44 and a right side 48. A left slit 46 is provided in the left side and a right slit 50 is provided in the right side. The movable component includes a vertical centerline 52 dividing the movable component into a left region 54 and a right region 56. A left cut in an inverted L-shaped configuration is formed in the left region forming a left tab 54. A right cut in an inverted L-shaped configuration is formed in the right region forming a right tab 56. The right tab extends through the right slit. The left tab extends through the left slit. The tabs and the slits guide a sliding movement of the movable component with respect to the fixed component. The fixed component is completely within the chamber spanning the first and second side walls. The movable component is movable between operative and inoperative orientations. The inoperative orientation is with the movable component completely within the chamber. The operative orientation is with the movable component partially inside of the chamber and partially outside of the chamber for use in pouring stored contents from the bag.

Lastly in this embodiment, an adhesive 66 is provided. The adhesive attaches the fixed component to the bag in the chamber. A peel strip 68 overlies the adhesive. The peel strip is removed to attach the fixed component to the bag in the chamber.

Reference is now made to FIGS. 6 through 13. In this embodiment of the system 100, the fixed component 104 includes a vertical centerline 106 dividing the fixed component into a left side 108 and a right side 110. A left vertical slit 112 is provide din the left side and a right vertical slit 114 is provided in the right side. The movable component includes a vertical centerline 116 dividing the movable component into a left region 118 and a right region 120. A left projection 112 with a left head 124 extends outwardly from the left region. A right projection 126 with a right head 128 extends outwardly from the right region. The left projection extends through the left slit. The right projection extends through the right slit. The projections and the slits guide a sliding movement of the movable component with respect to the fixed component.

Reference is now made to FIGS. 14 through 18. In this embodiment of the system 200, the fixed component 204 and the movable component 206 are an integrally formed component 202. P horizontal fold line 208 divides the integrally formed component into the fixed component and the movable component. A vertical fold line 210 creates a left side 212 and a similarly configured right side 214. The movable component is pivotable away from the fixed component whereby the vertical fold line is linear thereby positioning the movable component in an operative pouring orientation. The movable component is pivotable into contract with the fixed component whereby the vertical fold line is folded with the movable component positioned in facing contact with the fixed component in an inoperative non-pouring orientation. The horizontal and vertical fold lines guide a pivoting movement of the movable component with respect to the fixed component.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pouring device for use with a bag having an open top and a closed bottom and side walls between the open top and the closed bottom, the bag having a domain between the side walls laterally and the open top and closed bottom elevationally for contents to be poured, the pouring device located within the domain, the pouring device including a fixed component and a movable component wherein the fixed component includes a vertical centerline creating a left side and a right side, a left vertical slit in the left side and a right vertical slit in the right side, and wherein the movable component includes a vertical centerline dividing the movable component into a left region and a right region, a left cut in an inverted L-shaped configuration formed in the left region forming a left tab and a right cut in an inverted L-shaped configuration formed in the right region forming a right tab, the right tab extending through the right slit, the left tab extending through the left slit, the tabs and the slits guiding sliding movement of the movable component with respect to the fixed component.

2. A pouring device for use with a bag having an open top and a closed bottom and side walls between the open top and the closed bottom, the bag having a domain between the side walls laterally and the open top and closed bottom elevationally for contents to be poured, the pouring device located within the domain, the pouring device including a fixed component and a movable component wherein:

the fixed component (104) includes a vertical centerline (106) dividing the fixed component into a left side (108) and a right side (110), a left vertical slit (112) in the left side and a right vertical slit (114) in the right side, and the movable component includes a vertical centerline (116) dividing the movable component into a left region (118) and a right region (120), a left projection (122) with a left head (124) extending outwardly from the left region, a right projection (126) with a right head (128) extending outwardly from the right region, the left projection extending through the left slit, the right projection extending through the right slit, the projections and the slits guiding a sliding movement of the movable component with respect to the fixed component.

3. A pouring spout system (10) for pouring stored contents, the system comprising:

a bag (14) having a top (16) and a bottom (20) with first and second side walls (22)(24) between the top and the bottom, the bag having interior and exterior surfaces (26)(28), the top having an opening between the first and second side walls, a separable closure (32) adjacent to the opening, a chamber (30) beneath the separable closure for receiving contents;

a pouring assembly (36) having fixed component (38) and a movable component (40), the fixed component including a vertical centerline (42) dividing the fixed component into a left side (44) and a right side (48), the left side having a left slit (46) and the right side having a right slit (50), the movable component including a vertical centerline (52) dividing the movable component into a left region (54) and a right region (56), a left cut in an inverted L-shaped configuration formed in the left region forming a left tab (54) and a right cut in an inverted L-shaped configuration formed in the right region forming a right tab (56), the right tab extending through the right slit, the left tab extending through the left slit, the tabs and the slits guiding a sliding movement of the movable component with respect to the fixed component, the fixed component being completely within the chamber spanning the first and second side walls, the movable component being movable between operative and inoperative orientations, the inoperative orientation being with the movable component completely within the chamber, the operative orientation being with the movable component partially inside of the chamber and partially outside of the chamber for use in pouring contents from the bag; and an adhesive (66) attaching the fixed component to the bag in the chamber and a peel strip (68) overlying the adhesive prior to attaching the fixed component to the bag in the chamber.

* * * * *